US007093535B2

(12) United States Patent
Daniel et al.

(10) Patent No.: US 7,093,535 B2
(45) Date of Patent: Aug. 22, 2006

(54) SHORT PLATEN COMPATIBLE GUIDE TRACK INSERTION AND REMOVAL APPARATUS AND METHOD

(75) Inventors: Barton Wade Daniel, Kennesaw, GA (US); Scott Shepard, Lubbock, TX (US); Glenn Ellison, Lubbock, TX (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/925,679

(22) Filed: Aug. 25, 2004

(65) Prior Publication Data

US 2006/0042477 A1 Mar. 2, 2006

(51) Int. Cl.
*B65B 13/04* (2006.01)

(52) U.S. Cl. ..... 100/26; 100/3; 53/589

(58) Field of Classification Search ..... 100/2, 100/3, 8, 25, 26; 53/399, 589, 590
See application file for complete search history.

(56) References Cited

U.S. PATENT DOCUMENTS

| | | | | |
|---|---|---|---|---|
| 3,470,813 | A | 10/1969 | Nomm et al. | |
| 3,720,158 | A | 3/1973 | Sauer et al. | |
| 4,484,518 | A * | 11/1984 | Jaenson | 100/4 |
| 4,559,977 | A | 12/1985 | Dilley | |
| 4,561,349 | A | 12/1985 | Grenon | |
| 4,611,534 | A | 9/1986 | Kudlicka et al. | |
| 5,379,687 | A * | 1/1995 | Moseley | 100/3 |
| 5,546,855 | A * | 8/1996 | Van Doorn et al. | 100/11 |
| 5,755,084 | A | 5/1998 | Dekker | |
| 5,778,772 | A | 7/1998 | Schwede | |
| 5,890,423 | A | 4/1999 | Lih | |
| 6,536,336 | B1 * | 3/2003 | Jaenson et al. | 100/3 |
| 6,553,900 | B1 | 4/2003 | Daniel et al. | |
| 6,575,086 | B1 | 6/2003 | Pearson et al. | |
| 6,637,324 | B1 | 10/2003 | Stamps | |
| 6,705,214 | B1 | 3/2004 | Stamps | |

OTHER PUBLICATIONS

Communication Relating to the Results of the Partial International Search dated Jan. 12, 2006.

* cited by examiner

*Primary Examiner*—Derris H. Banks
*Assistant Examiner*—Jimmy T. Nguyen
(74) *Attorney, Agent, or Firm*—Husch & Eppenberger, LLC; Grant D. Kang; Dennis J. M. Donahue, III

(57) ABSTRACT

In a bulk material bate binder, the bulk material bale binder having a stand adjacent a baling station and being installed to bind bales compressed by an up press having a moving lower platen, the lower platen having insertion slots for guide tracks, a guide track removal and insertion apparatus including a guide track removal frame, the frame being hingedly mounted on the stand such that the guide track removal frame may rotate to and from an engaged position and a removed position; a guide track mount, pivotably mounted on the guide track removal frame, the guide track mount having an insertion position and a retracted position; a guide track section attached to the guide track mount, the guide track section having an insertion portion; and a linkage, the linkage having a first end and a second end, the first end being operatively engaged with the stand and the second end being operatively engaged with the guide track mount, such that during insertion and removal of the insertion portion of the guide track, the insertion portion remains at or above an insertion level at all times.

21 Claims, 12 Drawing Sheets

SHORT PLATEN COMPATIBLE GUIDE TRACK INSERTION AND REMOVAL APPARATUS AND METHOD

CROSS-REFERENCE TO RELATED APPLICATIONS

None.

STATEMENT REGARDING FEDERALLY SPONSORED RESEARCH OR DEVELOPMENT

Not Applicable.

APPENDIX

Not Applicable.

BACKGROUND OF THE INVENTION

1. Field of the Invention

This invention related generally to binding bales of bulk material such as cotton. In particular, the invention relates to the engagement of a removable section of binding wire or strap guide track with the lower platen of an up press.

2. Related Art

Fibrous materials such as cotton are typically bound into bales by compression presses which compress the bulk material into a preconfigured bale dimension. During compression, the bale is engaged by a bale binding apparatus that installs bale binders such as wire, metal strap or plastic strap in a preconfigured length around the bale. After the bale wire or strap ends are fixed or knotted, compression is released and a bound bale is ejected.

Compression of bulk material into a bale is often achieved with an "up press." An up press is comprised of a pit below floor level in which a vertically oriented hydraulic unit raises and lowers a platen in order to compress a volume of bulk material above it. The hydraulic shaft raises the platen and compresses a preconfigured volume of bulk material into a baling station, where its upward travel is arrested by an upper platen, against which the bulk material is compressed by continued upper travel of the lower platen. The baling station is above ground level where it may be engaged by a bale binding apparatus. The operations of bale binding apparatuses are described in prior patents such as U.S. Pat. No. 6,637,324 to Stamps and U.S. Pat. No. 6,553,900 to Daniel et al. These patents are incorporated by reference herein.

Up presses are expensive to build and install. The cost of up presses is directly proportional to the depth of the pit required by them. Deeper pits require correspondingly longer hydraulic reaches and deeper and larger lower platens and the following blocks that support them. The deep pits with their large dimension components require more expensive materials and components, such as steel. There is a need in the industry to reduce the amount and thus the expense of materials used. Correspondingly, there is a need in the art to use shallower platens.

FIGS. 1 and 2 depict a prior art bale binder apparatus. A bale forming and binding apparatus 10 has two positions; the solid lines illustrate a first position wherein the moveable wire guide section 48 completes the wire guide track trajectory as when the binding operation is occurring; and the broken lines illustrate a second position wherein the moveable wire guide section 48 is in a position 48*a*. A floor plate 12 supports vertical support stands 14 on either side of the bale forming and binding station 16. A binding assembly carriage 18 is borne by stands 14. The base extension 20 of the carriage 18 carries the fixed tying heads 40 and attached wire guide track sections 39. The carriage 18 translates in a direction perpendicular to the plane of the drawing along an overhead track 22 attached to the upper rear extent of the stands 14 and its motion is controlled by drive 24.

Extending from the upper forward extent of the stands 14 are a pair of pivot axis brackets 25 holding the pivot axis 26 which carries the moveable guide track support strut assembly 28. Extending forward from the center of the strut assembly 28 is a member 30 pivotally connected at pin 32 to the piston arm 34 which is extended and withdrawn by action of the piston 36. The action of the piston 36 may be by any means but is preferably pneumatic.

The binding wire entering the apparatus 10 from the wire supply (not shown) at the wire control head 41 are directed by guide track sections 38 to and from the tying head 40 which fastens the wire into a closed loop. The guide track section 44 lies in a channel within the bale forming compressor 42 which accommodates the wire trajectory above the bale forming station 46 containing the bulk material (not depicted). The positions 28*a*, 34*a*, 36*a* and 48*a* show the parts 28, 34, 36 and 48 in their respective positions when the apparatus is in the arrangement whereby the moveable guide track section is at a remove from the bale forming station 46. The upper moveable guide track section terminus 50 and the lower moveable guide track section terminus 52 meet the guide track sections 46 and 38 respectively to complete the wire guide track. The dashed line 54 illustrates the path of motion of the lower terminus 52 as it transits between positions.

As evident by dash line 54, an insertion portion of guide track 48, including guide track end 52 describe an arc of travel that extends substantially lower than the final insertion position of the guide track in the lower platen. The insertion level of the lower guide track, IL is a level at which it engages the stationary portion of the guide track 38 and completes a guide track loop around the baling station. This arc of travel 54 requires a dimension D, which must be clear of obstructions so that the guide track 52 can transverse it. In order to achieve this, the prior art bale binder depicted in FIG. 1 required a lower platen that was increased in height by at least dimension D.

In order to accommodate shorter lower compression platens demanded in the industry, there is a need for a bale binding apparatus that inserts and removes an insertion portion of a removable guide track section without moving the insertion portion of the lower guide track section through any space lower than the level of its final insertion level.

In order to accommodate the need for shorter platens in bulk material up presses, there is consequently a need for bulk material balers designed to engage up presses in a way that accommodates shorter platens.

SUMMARY OF THE INVENTION

It is in view of the above problems that the present invention was developed. Referring to the accompanying drawings in which like reference numbers indicate like elements.

The invention is for a bulk material bale binder, the bulk material bale binder having a stand adjacent a baling station and being installed to bind bales compressed by an up press having a moving lower platen, the lower platen having insertion slots for guide tracks. A guide track removal and insertion apparatus has a guide track removal frame, the frame being hingedly mounted on the stand such that the guide track removal frame may rotate between an engaged position and a removed position. A guide track mount, pivotably mounted on the guide track removal frame has an insertion position and a retracted position. A guide track section attached to the guide track mount has an insertion portion. A linkage has a first end operatively engaged with a stand and the second end operatively engaged with the guide track mount, such that during insertion and removal of the insertion portion of the guide track, the insertion portion remains at or above an insertion level at all times.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention.

FIG. 3 is a side view of the present invention in an engaged position;

FIG. 4 is a side view of the present invention in a first removed position;

FIG. 5 is a side view of the present invention in a second intermediate removed position;

FIG. 6 is a side view of the present invention in a third intermediate removed position;

DETAILED DESCRIPTION OF THE PREFERRED EMBODIMENTS

Figure 1:
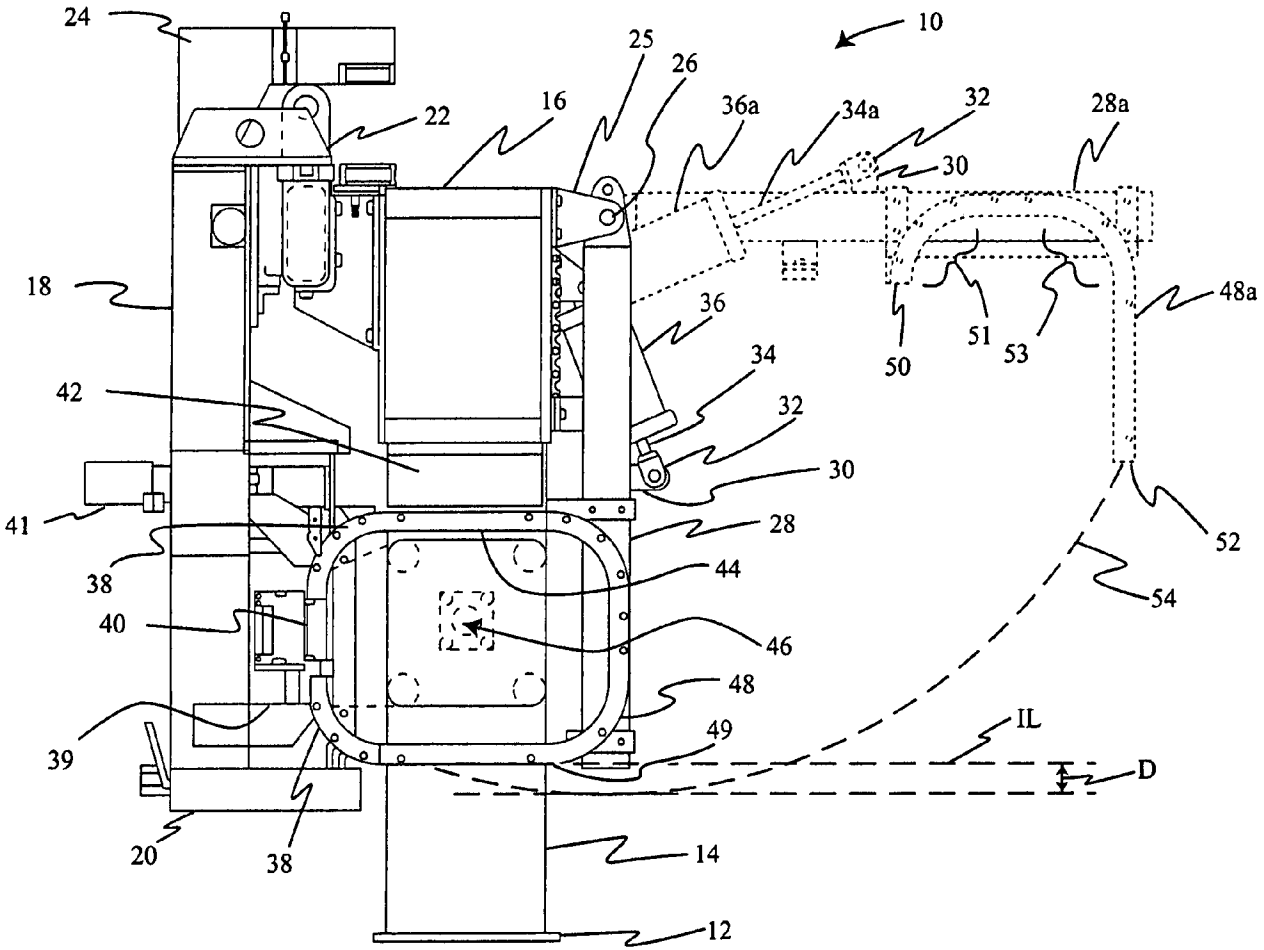
Figure 1 Prior Art
FIG. 1 is a side view of a prior art baler.
Figure 2:
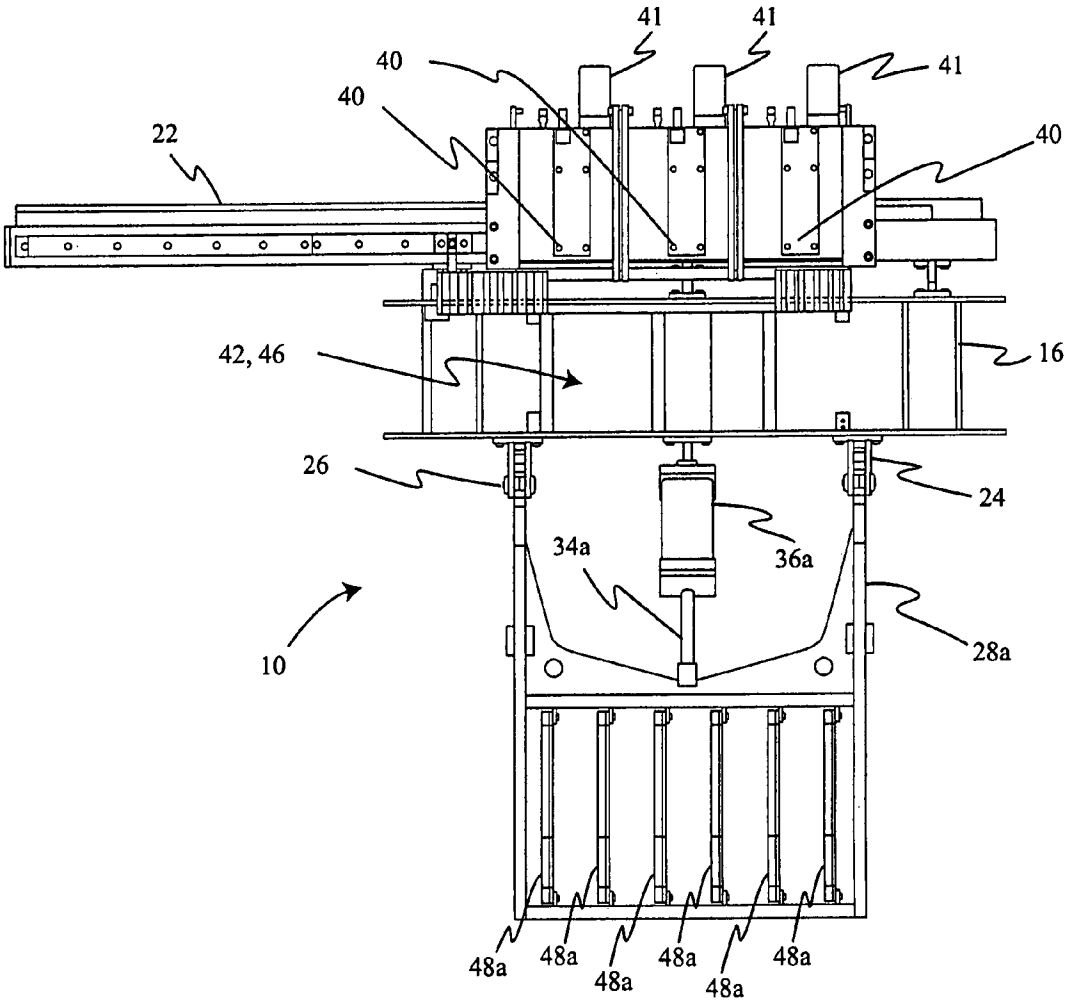
Figure 2 Prior Art
FIG. 2 is a partial top view of a prior art baler.

Referring to the accompanying drawings in which like reference numbers correspond to like elements, FIGS. 3, 4, 5, 6, 7 and 8 depict the shortened platen compatible lower guide track insertion and removal assembly of the present invention in six different positions along its arc of travel. The assembly is in operative engagement with an otherwise standard bulk material bale binder for an up press. Depicted in FIGS. 3–8 are binder stand 116 and baling station 146.

Also shown is a moveable guide track section 148, which includes an insertion portion 150. In the depicted embodiment, the removable guide track section 148 and the insertion portion 150 do not move relative to one another. The removable guide track section 148 is attached to guide track mount 160. In the depicted embodiment, the removable guide track section 148 and insertion portion 150 do not move relative to the guide track mount 160. Guide track mount 160 is pivotably attached at pivot axle 162 to the guide track removal and insertion frame 128. As the apparatus moves through its arc of travel, the removable guide track section 148 and its mount 160 move relative to the guide track removal frame 128 by rotating around pivot 162.

As in the prior art, guide track removal frame 128 is moved into and out of its engaged position by a piston and cylinder assembly 136, which may be hydraulic or pneumatic mechanical or electromechanical (omitted from FIGS. 3–6 for clarity). The removal frame may be pivotably connected with the cylinder and the stand with the piston, or visa versa.

The movement of the guide track removal frame 128 is around pivot 126, by which it is mounted on a bracket extension 125 fixedly attached to stand 116. When a bale has been bound and is ready for ejection, piston and cylinder assembly 136 swings the removal frame 128 around pivot 126 up and away from the baling station 146. Thereafter the bound bale is ejected and more bulk material is installed in the compression pit, the compressor raises the lower platen, compressing the material in the baling station 146, and the guide track removal frame 128 is rotated back down in order to engage removable guide track section 148 with the fixed guide track portions so that the bale binder apparatus is again ready for binding the next bale.

Figure 3:
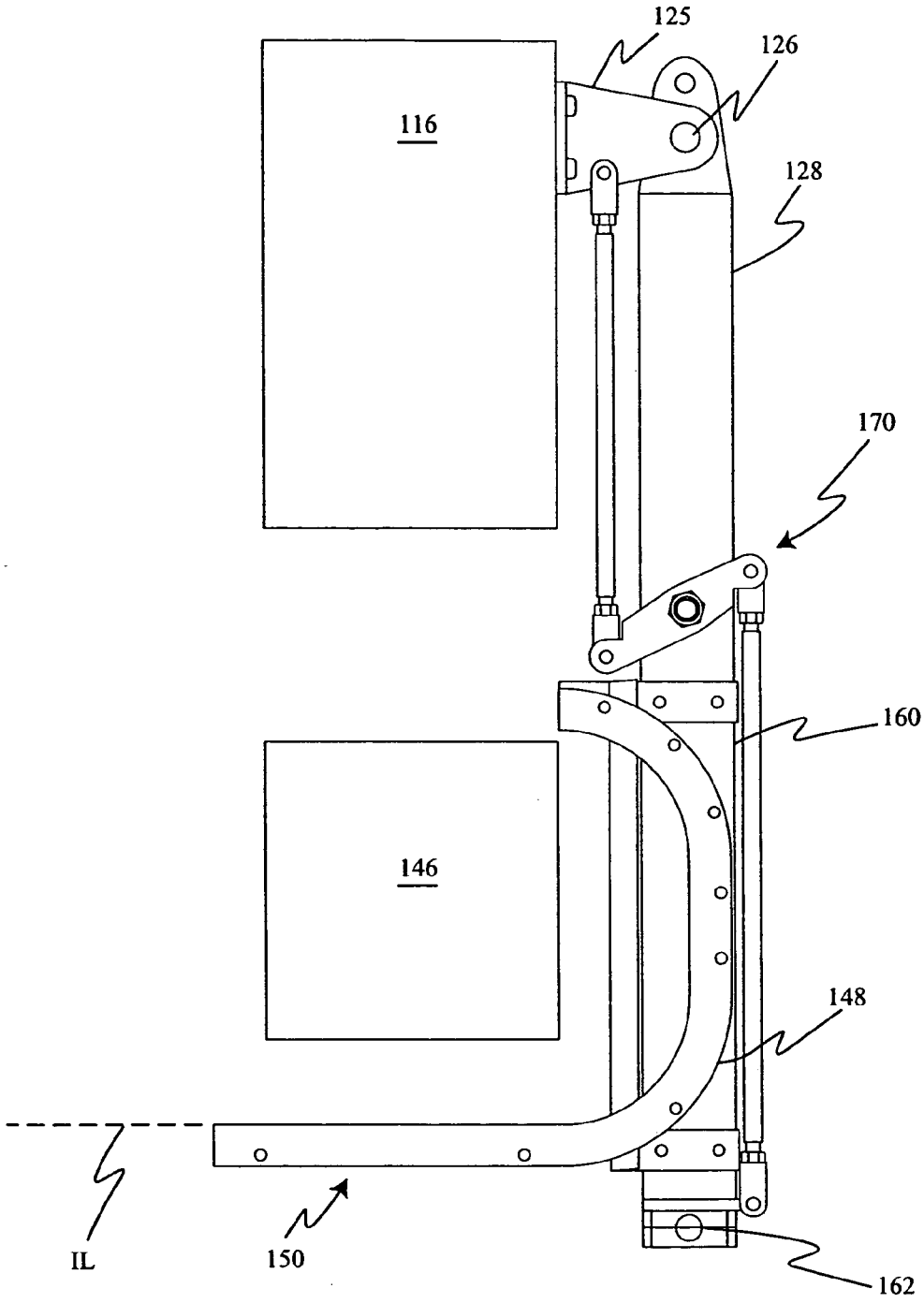
FIGS. 3, 4, 5 and 6 are side views of the short platen compatible binder with a removable guide track frame and the short platen lower guide track assembly. In the drawings.
Figure 4:
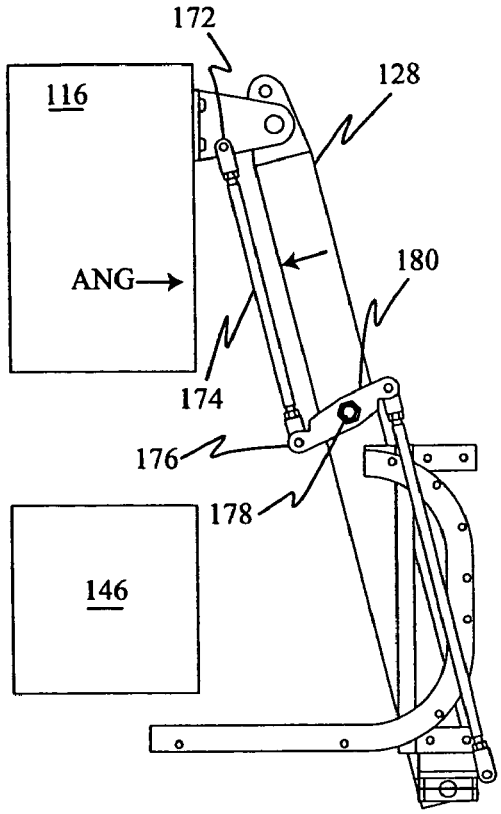
Figure 5:
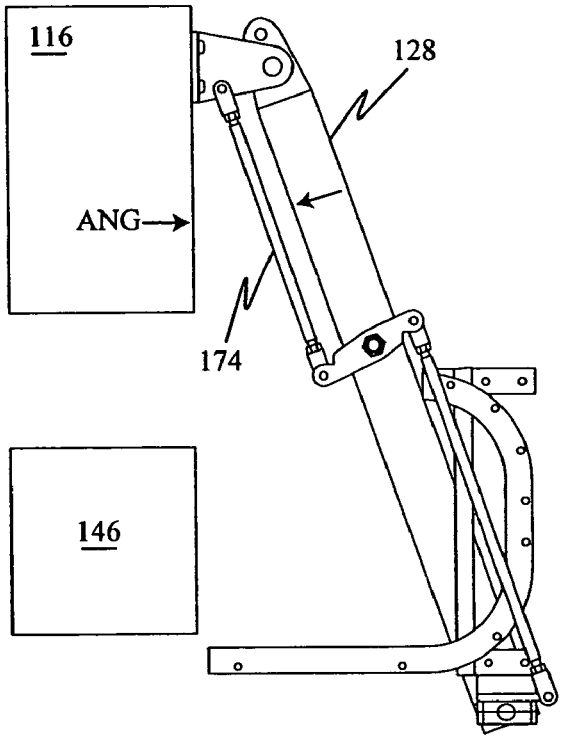
Figure 6:
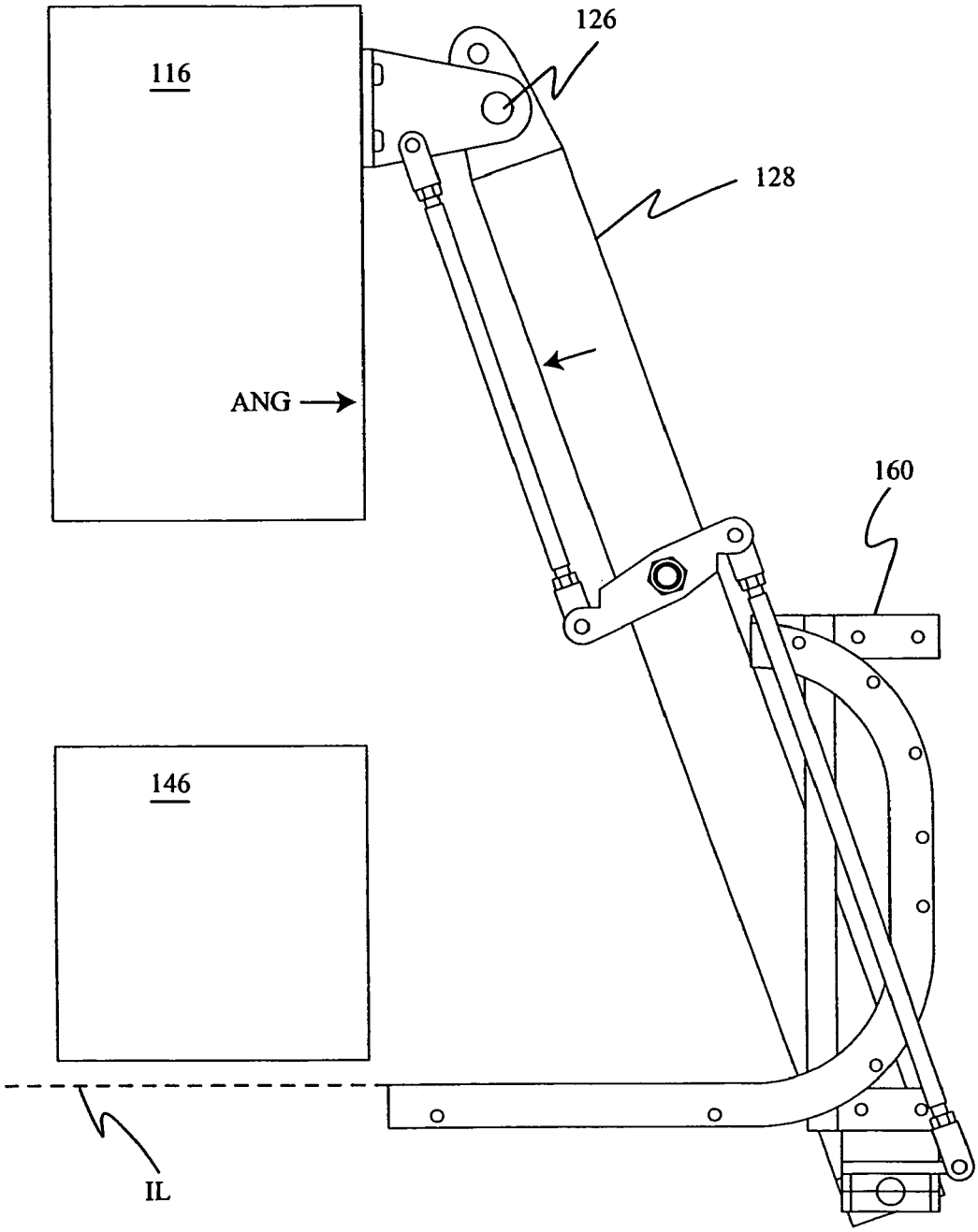
Figure 7:
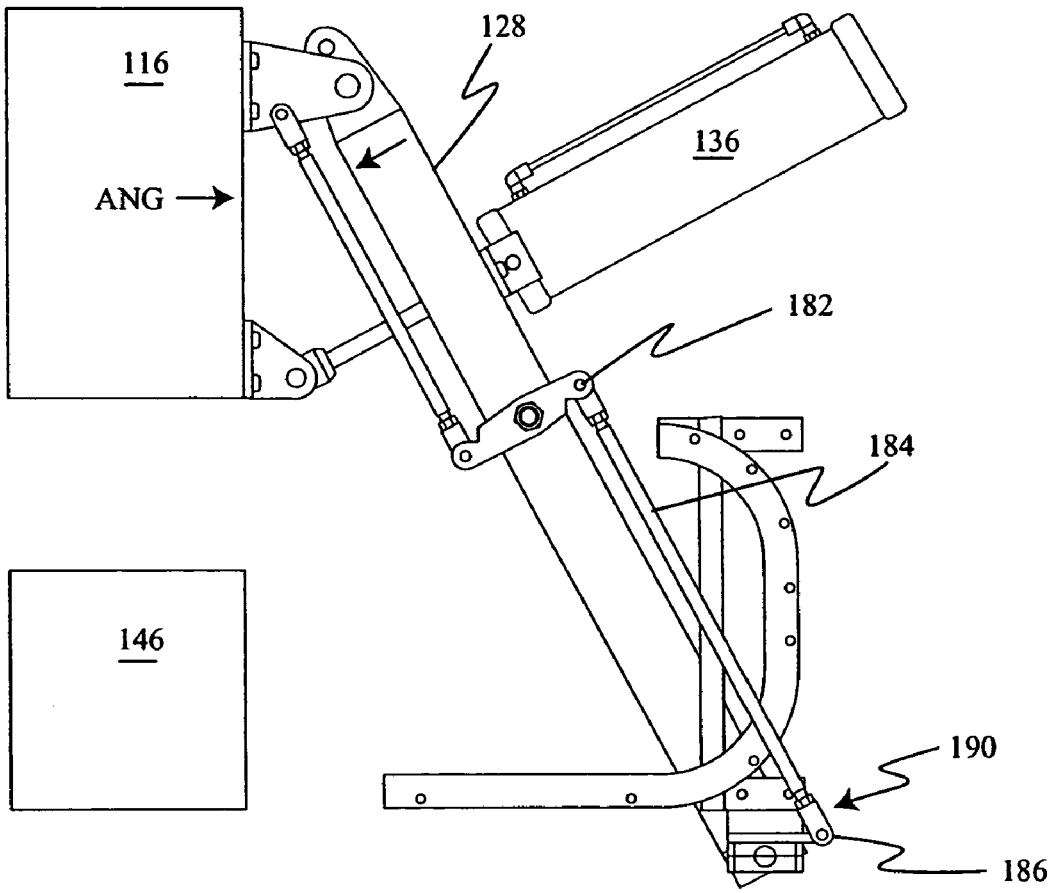
FIG. 7 is a side view of the present invention in a fourth intermediate removed position.
Figure 8:
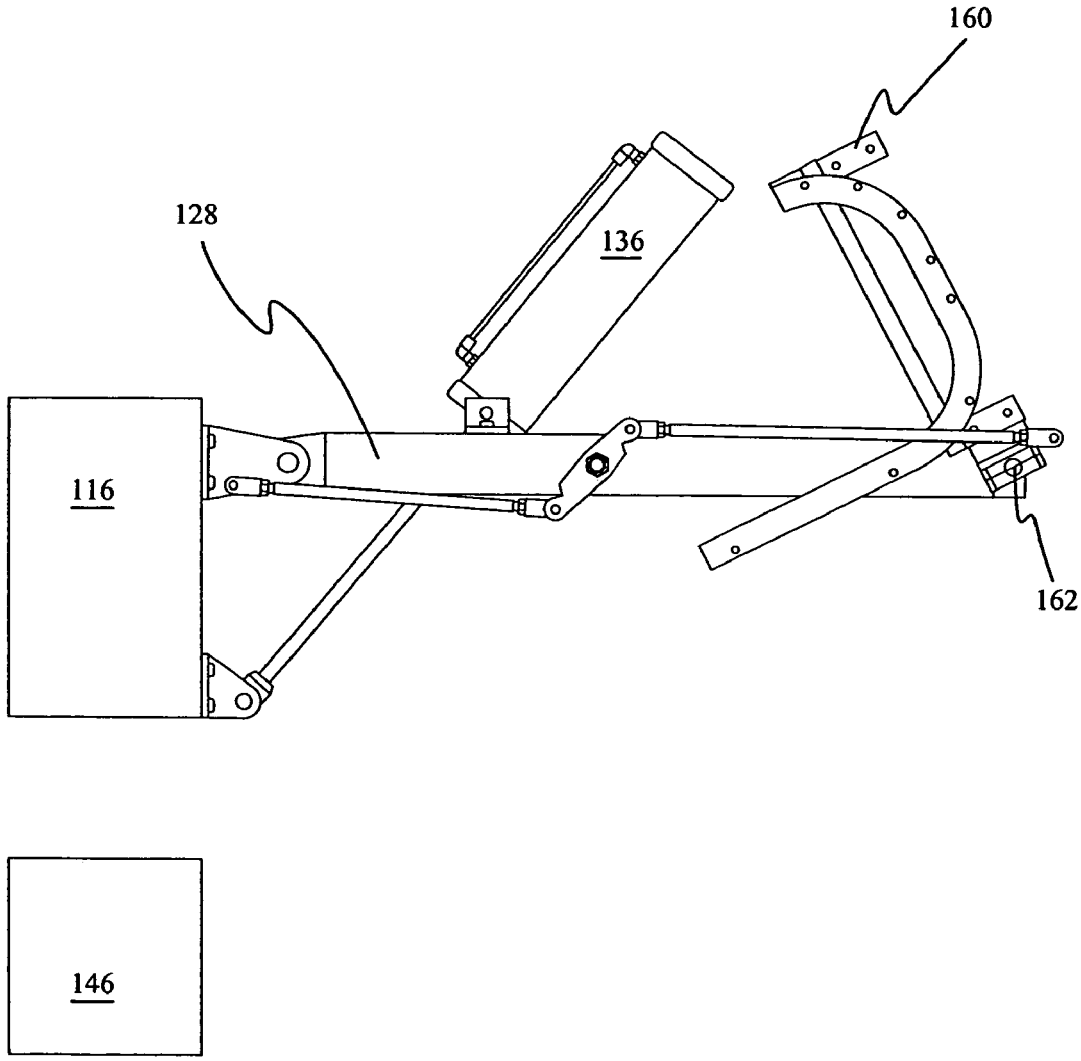
FIG. 8 is a side view of the present invention in a fully removed position.

The depicted embodiment of the present invention maintains the insertion portion 150 of the removable guide track section 148 at or above an insertion level IL. The insertion level, of course, corresponds to a platen slot dimensioned to receive the insertion portion 150 of the removable guide track section 148. FIG. 3 depicts the removable guide track section 148 fully lowered and fully engaged with the rest of the bale binding apparatus for binding. FIG. 4 depicts the removable guide track frame and removable guide track 148 at a first intermediate position through which the apparatus will move during removal from the baling station. FIGS. 5, 6 and 7 depict the apparatus at intermediate positions and FIG. 8 at a fully removed position. In FIG. 3, the insertion portion 150 is at an angle with the removal frame 128, that in the depicted embodiment, is substantially perpendicular. As the removal frame rotates to moves the guide track section 148 from its engaged position to its removed position, the insertion portion 150 changes its angle relative to the removal frame 128. The angle changes from the substantially perpendicular insertion angle to a more acute angle. As is apparent in FIGS. 3–8, the insertion portion 150 of the removable guide track section 148 is maintained at or above the insertion level IL at all times. This achieved with linkage 170.

Linkage 170 is comprised of a first tie rod 174 having a first end pivotably attached to the stand. In the depicted embodiment, the pivotable attachment 172 of the first end of tie rod 174 is on the bracket extension 125. It is within the scope of the present invention that tie rod 174 may be attached to any portion of the stand 116 or its fixed attachments, provided that the fixation point does not move with the guide track removal frame 128. The second end of tie rod 174 is attached to a first swing arm 180. This attachment of the second end of tie rod 174 is at a pivot point 176. Swing arm 180 is attached to guide track removal frame 128 at a swing arm pivot point 178.

As guide track removal frame 128 swings up and away from the baling station 146, a distance between first tie rod pivot 172 and a closed position of second tie rod pivot point 176 is biased to increase. The tie rod, being rigid, exerts tension on swing arm 180. Because swing arm 180 is pivotably mounted at pivot 178 to the guide track removal frame 128, it rotates in response to the exerted traction of tie rod 174. In the depicted embodiment, the rotation is clockwise. The clockwise rotation during removal of guide track removal frame 128 pushes a compressive force on a second tie rod 184 (see FIG. 7). The second tie rod 184 is attached to the first swing arm 180 at the pivot point 182.

A second end of second tie rod 184 is pivotably attached at pivot 186 to a bottom area of the guide track mount 160 at bracket 190. The second tie rod pushes guide track mount 160 to rotate around guide track mount pivot point 162. The compressive force exerted on second tie rod 184 is received by bracket 190 which is attached to guide track mount 160. This correspondingly rotates the guide track mount 160 and removable guide track section 148, also in a clockwise direction, relative to guide track removal frame 128 as it swings up and away from the baling station 146.

For reinsertion of the removable guide track section 148, piston and cylinder assembly 136 lowers the guide removal frame 128, and the linkage 170 rotates the guide track mount 160 and removable guide section 148 in the opposite direction, that is counter clockwise in the depicted embodiment.

Figure 9:
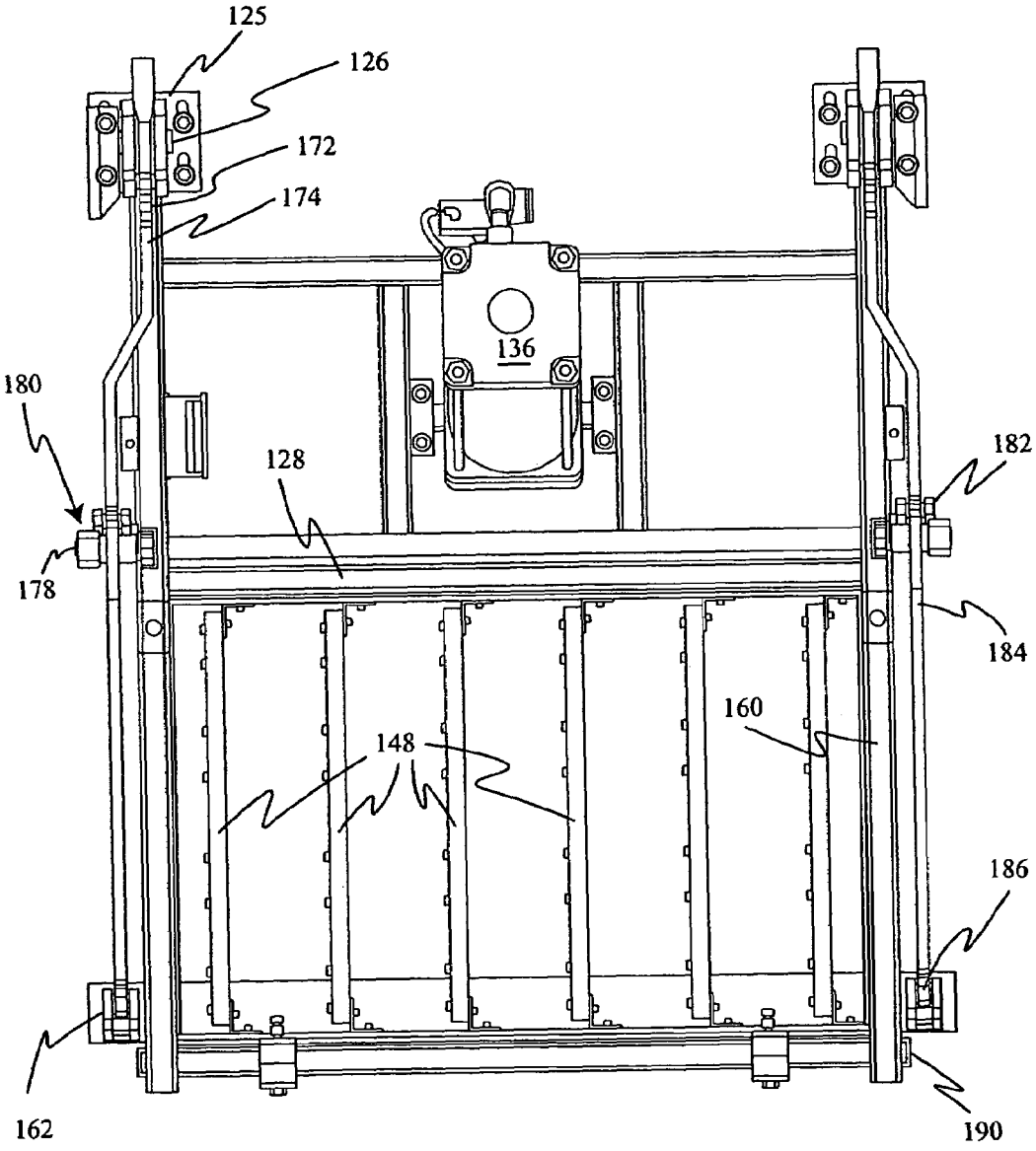
FIG. 9 is a front view of the present invention.

FIG. 9 is a front view of the entire removal frame. It can be seen that the top or first tie bar 174 has a bend in it comprised of two complementary angles of approximately 30 degrees. For baling standard bales of cotton according to the standards of the International Cotton Council, six bale wires are used. Accordingly six guide track sections 148 are mounted on the removal frame 128. Because these six frames guide track sections 148 are mounted, the guide track section mount 160 is configured as a rectangle to accommodate the dimensions of the guide track sections 148. The use of the guide track mount 160 saves material cost and improves durability by over individual pivotable mounting of each individual guide track section 148.

Figure 11:
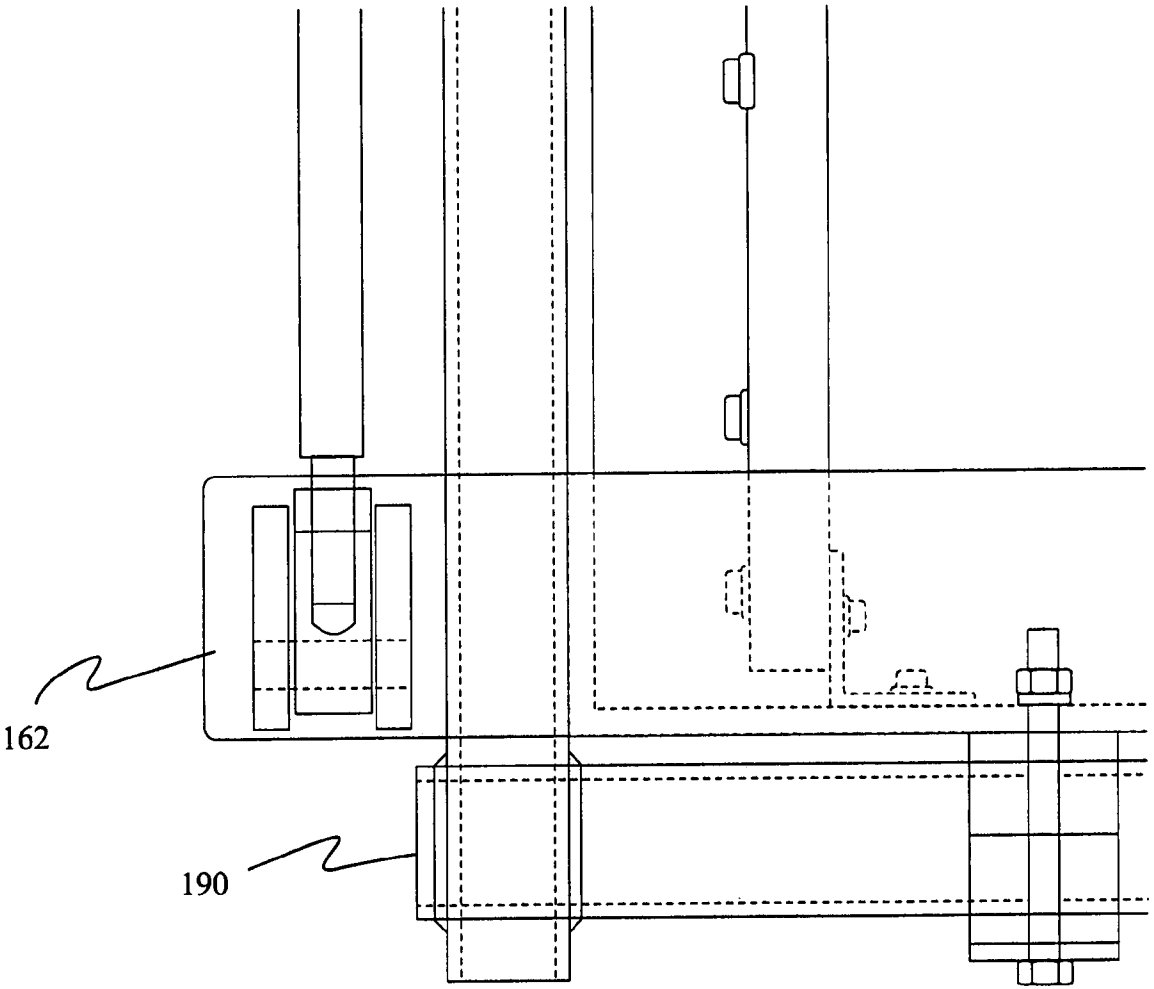
FIG. 11 is a close up of a lower pivot of a second tie rod.

As can be seen, the guide track mount 160 is pivotably mounted at spanner 162. A close up front view of this connection is seen at FIG. 11. There can be seen that the guide track mount 160 is pivotably mounted to the removal frame 128 at pivoting joint 190 so that the removal frame 160 can rotate around a bar, which in the depicted embodiment is a approximately two inch diameter pipe welded onto the removal frame 128. Also seen in FIG. 11 is a close up of the pivoting joint 162 whereby the second tie rod 184 exerts pressure in a levered relation to the pivot 190 of the guide track section frame 160. That is to say, the pivoting joint 162 is sufficiently offset from the axis of rotation 190 of the guide track mount 160 to obtain a mechanical advantage thereover and cause the mount to rotate around axis 190 when the frame 128 is raised. Thus, the guide track sections 148 and insertion portions 150 mounted to guide track mount 160 will move from their insertion angle through increasingly more acute angles as the guide track mount 160 pivots when the removal frame 128 is raised.

Figure 10:
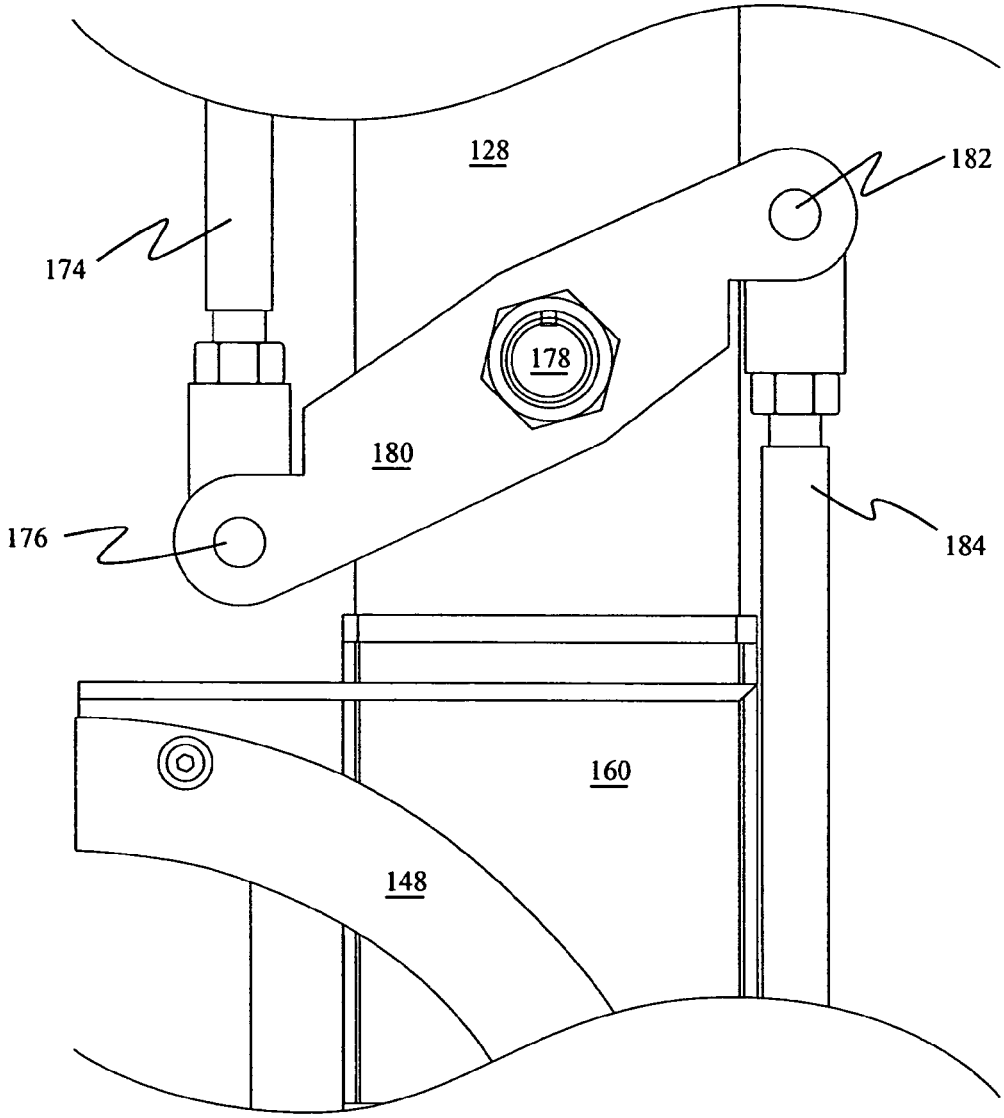
FIG. 10 is a close up of a swing arm.
Figure 12:
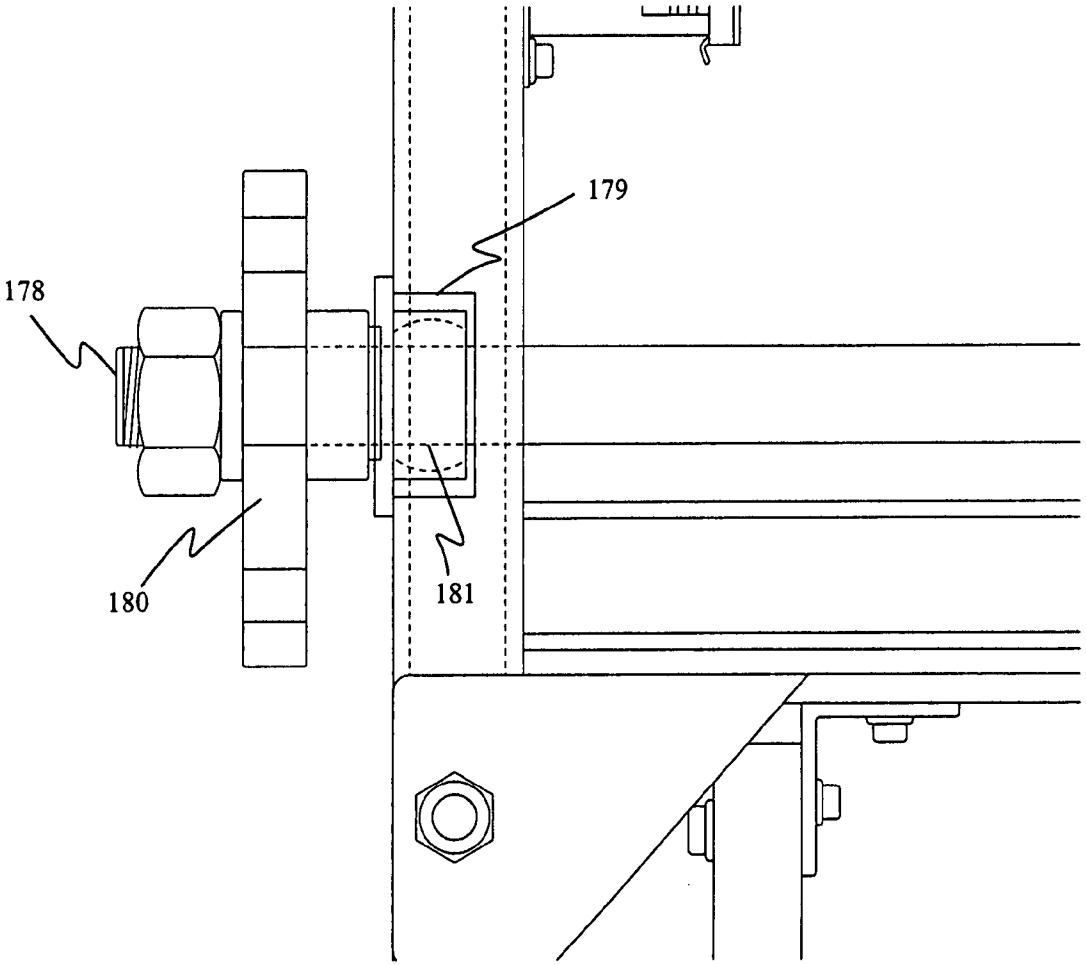
FIG. 12 is a close up front view of a swing arm.
Figure 13:
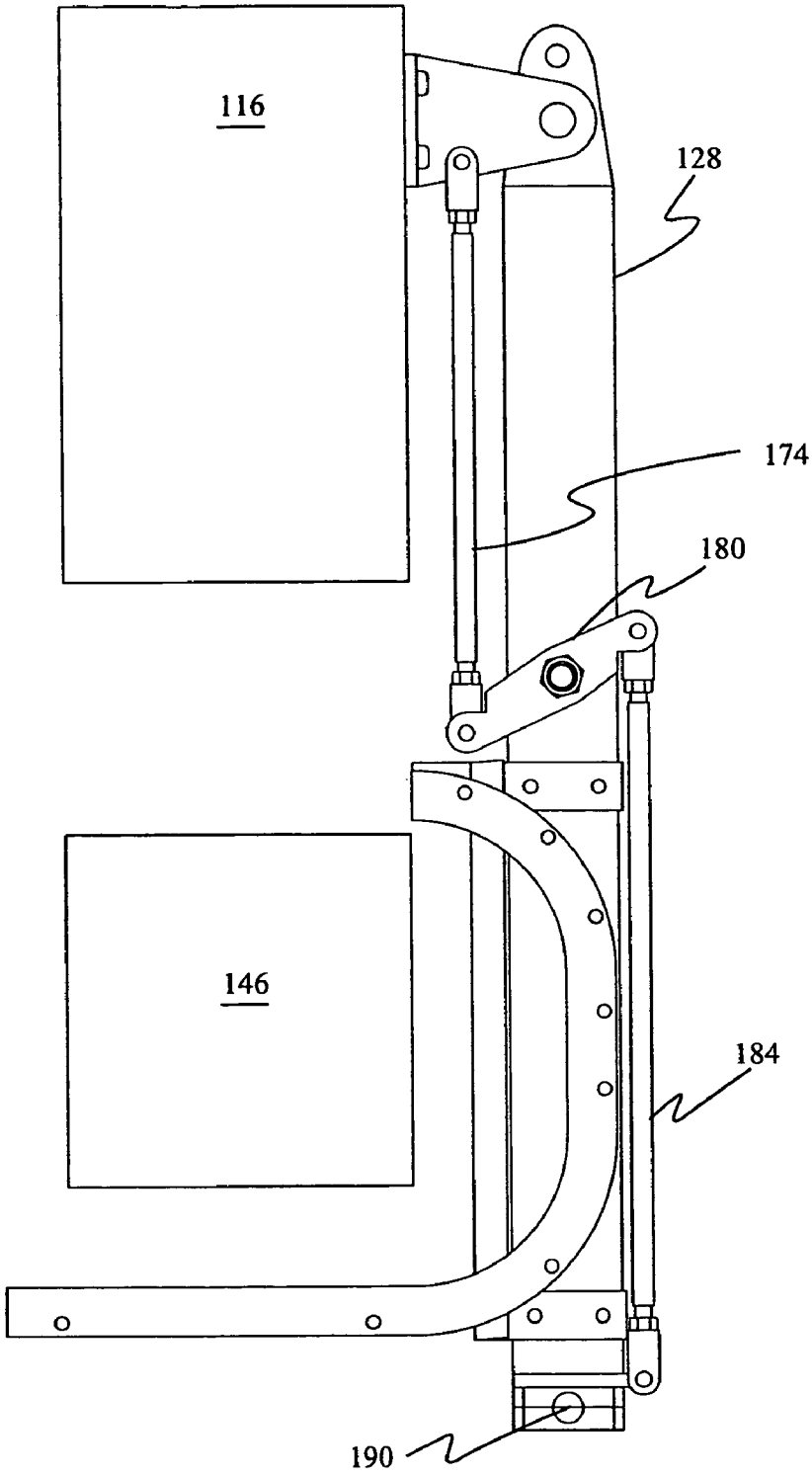
FIG. 13 is a side view of the invention.

FIGS. 10 and 12 are close-ups, a side view and front view respectively, of the swing arm 180. As can be seen, the joint 178 in the depicted embodiment is constructed by welding a cup 179 into the side of the side portion of the removal frame 128 and installing therein a semi-spherical bearing, which allows the swing arm 180 to rotate around the axis 178. As best seen on FIG. 10, the first tie rod 174 is pivotably mounted at 176 to a first portion of the swing arm 180. When the removal frame 128 is raised, tie rod 174 will exert a tractive force, that is, it will pull swing arm 180 at a direction that is clockwise in the depicted embodiment and centered around axis 178. A second portion of the swing arm 180 serves as a mount for pivot point 182, to which a first end of a second tie rod 184 is pivotably mounted. As the swing arm 180 rotates clockwise, it will exert a compressive force on tie rod 184. As has been seen in FIGS. 9 and 11, it is this pushing or compressive force on tie rod 184 against this pivotable mount 162 of the second end of the second tie rod 184 that completes the linkage and pivots guide track mount 160.

In operation, a bale is bound, and binding wires knotted and the bale completed. Before compression can be released, the guide track must be removed from the lower platen slots. Accordingly, the removal frame 128 is rotated upwards by the piston and cylinder assembly 136. Removal frame 128 rotates around axis 126. Because this axis is offset from a pivot point 172 of first tie rod 174, the linkage 170 has an actuating force applied to it simply by virtue of the fact that the removal frame is being raised. As has been seen, the first tie rod 174 rotates the swing arm 180 in a clockwise direction, which causes the second tie rod 184 to push downwards and outwards, which, by virtue of its levered interaction with guide track mount 160 and its pivotable mounting at axis 190, causes the guide track mount 160 to rotate, carrying with it the guide track sections 148 and turning the insertion portions 150 thereof through increasingly acute angles as the frame is raised.

As displayed in FIGS. 3–8, the simultaneous rotation of the insertion portion 150 through its increasingly acute angles relative to the perpendicular insertion angle, occurs simultaneously with the rotation upwards of the removal frame 128. In this manner, a lower reach is established at the insertion level and maintained above it. That is, the insertion is level is the lowest point of the travel arc of the insertion portion 150 of the removable guide track sections 148. Accordingly, shorter slots and therefore shorter lower platen following blocks may be used, saving material cost. Prior art platens and/or the following blocks that support them were over 12" high–13⅝" in the most common models. This was to accommodate dimension D, representing wasted spaced below IL. In the embodiments depicted herein, dimension D is substantially about 5–6" high, 5½" as shown. Accordingly, the present invention saves 5 to 6" of wasted height and corresponding material cost. It allows use of a platen/follower block assembly that is substantially 9" or less in height.

After the removal frame 128 has reached a level sufficient for clearance, a finished bale is ejected. Thereafter, a new volume of bulk material is compressed into the baling station 146 and held there. Next, the removal frame 128 is rotated clockwise and downwards to reinsert the removal guide track sections 148 into their operative position, which closely cooperates with other guide track sections in a known manner. The linkage works in an opposite manner, and may be assisted by gravity, such that swing arm 180 rotates in a counterclockwise direction, the insertion portions 150 also rotate in a counterclockwise direction until they rotate once again into a substantially perpendicular angle to the removal frame 128 as they are inserted into the slots dimensioned to receive them in the following block of the lower platen. Once again, the insertion level is the lowest level of the arc of travel of the insertion portions 150 of the removal guide track sections 148 as they are inserted.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. In a bulk material bale binder, said bulk material bale binder having a stand adjacent a baling station and being installed to bind bales compressed by an up press having a moving lower platen, the lower platen having insertion slots for guide tracks, a guide track removal and insertion apparatus comprising:

a guide track removal frame, said frame being hingedly mounted on the stand such that said guide track removal frame may rotate to and from an engaged position and a removed position;

a guide track mount, said guide track mount pivotably mounted on said guide track removal frame, said guide track mount having an insertion position and a retracted position;

a guide track section attached to said guide track mount, said guide track section having an insertion portion; and a linkage, said linkage having a first end and a second end, said first end being operatively engaged with the stand and said second end being operatively engaged with said guide track mount, such that during insertion and removal of said insertion portion of said guide track section, said insertion portion remains at or above an insertion level at all times, wherein said linkage comprises:

a first tie rod having a first end and a second end, said first tie rod end being pivotably attached to the stand;

a swing arm being pivotably attached to said guide track removal frame at an intermediate position, said swing arm having a first portion and a second portion, said first portion having a pivotable attachment to said second end of said first tie rod;

a second tie rod having a first end and a second end, said first end of said second tie rod being pivotably attached to said second portion of said swing arm;

said second end of said second tie rod being pivotably attached to said guide track mount such that said guide track mount pivots as said guide track removal frame leaves said engaged position.

2. The apparatus of claim 1 wherein said insertion portion remains substantially parallel to the ground at all times.

3. The apparatus of claim 1 wherein said insertion portion is substantially perpendicular to said removal frame at said insertion position, and generally forms an acute angle with said removal frame at every other position.

4. The apparatus of claim 1 wherein said guide track removal and insertion apparatus is configured for compatibility with a short platen.

5. The apparatus of claim 4 wherein said platen is equal to or less than 9 inches tall.

6. The apparatus of claim 1 wherein said insertion portion does not move relative to said guide track section.

7. The apparatus of claim 1 wherein travel of said guide track removal frame is mediated by a piston and cylinder, said cylinder connected to one of said guide track removal frame or said stand and said piston being operatively connected to the other of said guide track removal frame or said stand.

8. The apparatus of claim 7 wherein said piston and cylinder are powered by a power source selected from a group consisting of:

hydraulic, pneumatic, mechanical and electromechanical.

9. The apparatus of claim 1 wherein said linkage applies tension to said guide track mount.

10. The apparatus of claim 1 wherein said linkage applies compression to said guide track mount.

11. A method of guide track insertion and removal for a bale binder having a guide track removal apparatus and a stand comprising;

rotationally mounting a guide track removal frame on the stand of said bale binder, such that said guide track may rotate between an inserted position and removed position;

pivotably mounting a guide track mount on said guide track removal frame, said guide track mount having an insertion position and a retracted position;

pivotably mounting a removable guide track section on said guide track mount, such that said guide track section may pivot between an insertion angle and a removed angle; and attaching a first end of a linkage to the stand and a second end of said linkage to said guide track mount such that said linkage rod enables the movement of the removable guide track section to and from said insertion angle at said insertion position through a path always at or above an insertion level, wherein said linkage comprises:

a first tie rod having a first end and a second end, said first tie rod end being pivotably attached to the stand;

a swing arm being pivotably attached to said guide track removal frame at an intermediate position, said swing arm having a first portion and a second portion, said first portion having a pivotable attachment to said second end of said first tie rod; and a second tie rod having a first end and a second end, said first end of said second tie rod being pivotably attached to said second portion of said swing arm;

said second end of said second tie rod being pivotably attached to said guide track mount such that said guide track mount pivots as said guide track removal frame leaves said engaged position.

12. The method of claim 11 wherein said insertion portion remains substantially parallel to the ground at all times.

13. The method of claim 11 wherein said insertion portion is substantially perpendicular to said removal frame at said insertion position, and generally forms an acute angle with said removal frame at every other position.

14. The method of claim 11 wherein said guide track removal and insertion apparatus is configured for compatibility with a short platen.

15. The method of claim 14 wherein said platen is equal to or less than 9 inches tall.

16. The method of claim 11 wherein said insertion portion does not move relative to said guide track section.

17. The method of claim 11 wherein travel of said guide track removal frame is mediated by a piston and cylinder, said cylinder connected to one of said guide track removal frame or said stand and said piston being operatively connected to the other of said guide track removal frame or said stand.

18. The method of claim 17 wherein said piston and cylinder are powered by a power source selected from a group consisting of:

hydraulic, pneumatic, mechanical and electromechanical.

19. The method of claim 11 wherein said linkage applies tension to said guide track mount.

20. The method of claim 11 wherein said linkage applies compression to said guide track mount.

21. A guide track removal and insertion apparatus for use with a bulk material bale binder, the bulk material bale binder having a stand adjacent a baling station and being installed to bind bales compressed by an up press having a moving lower platen, the lower platen having insertion slots for guide tracks, the guide track removal and insertion apparatus comprising:

a guide track removal frame, said guide track removal frame being hingedly mounted on the stand such that said guide track removal frame may rotate to and from an engaged position and a removed position;

a guide track mount, said guide track pivotably mounted on said guide track removal frame, said guide track mount having an insertion position and a retracted position;

a guide track section attached to said guide track mount, said guide track section having an insertion portion;

a first tie rod having a first end and a second end, said first tie rod end being pivotably attached to the stand;

a swing arm being pivotably attached to said guide track removal frame, said swing arm having a first portion and a second portion, said first portion having a pivotable attachment to said second end of said first tie rod; and a second tie rod having a first end and a second end, said first end of said second tie rod being pivotably attached to said second portion of said swing arm, said second end of said second tie rod being pivotably attached to said guide track mount such that said guide track mount pivots as said guide track removal frame leaves said engaged position.

* * * * *